United States Patent [19]

Stearns

[11] Patent Number: 4,753,000

[45] Date of Patent: Jun. 28, 1988

[54] METHOD OF MAKING SNAP ACTION SWITCHES

[75] Inventor: Thomas H. Stearns, Nashua, N.H.

[73] Assignee: Advanced Circuit Technology, Nashua, N.H.

[21] Appl. No.: 908,605

[22] Filed: Sep. 18, 1986

Related U.S. Application Data

[63] Continuation of Ser. No. 563,220, Dec. 19, 1983, abandoned.

[51] Int. Cl.[4] ..... H01H 11/04

[52] U.S. Cl. ..... 29/622; 29/874; 200/67 D; 200/67 DA; 200/72 R

[58] Field of Search ..... 29/622, 827, 874; 200/67 D, 67 DA, 72 R

[56] References Cited

U.S. PATENT DOCUMENTS

| | | | |
|---|---|---|---|
| 2,374,435 | 4/1945 | Jordan | 200/72 R |
| 2,700,079 | 1/1955 | Haydon | 200/67 DA |
| 3,389,902 | 6/1968 | Young | 200/67 D |
| 3,900,709 | 8/1975 | Sheesley et al. | 200/5 R |
| 4,311,884 | 1/1982 | Henley et al. | 200/6 R |
| 4,402,131 | 9/1983 | Roberts | 29/622 |

FOREIGN PATENT DOCUMENTS

| | | | |
|---|---|---|---|
| 1442196 | 7/1976 | United Kingdom | 29/622 |

*Primary Examiner*—P. W. Echols
*Attorney, Agent, or Firm*—Cesari and McKenna

[57] ABSTRACT

A switch module includes a base and an array of one or more switches spaced adjacent to one another on the base. Each switch includes a fixed contact as well as a moving contact and supporting arm therefor. All of the switches in the array are formed from a single planar conductive blank composed of a closed frame and first and second sets of opposed elongated cantilevered panels extending from opposite sides of the frame, one set of panels forming the stationary contacts and the other set of panels forming the moving contacts and supporting arms therefor. The blank is deformed to move all of the corresponding stationary and moving contacts into overlapping relation and to give bias to all of the contact arms so that they urge the associated moving contacts into or out of engagement with the corresponding fixed contacts. All of the switches while they are still integral parts of the deformed blank are mounted to the base so that the relative positions on the base of all of the switch contacts are predetermined by their positions in the deformed blank. Finally, the deformed mounted blank is severed at selected locations to electrically isolate some or all of the switch contacts mounted to the base. Various blanks for making the switch module are disclosed as is the method for doing same.

8 Claims, 4 Drawing Sheets

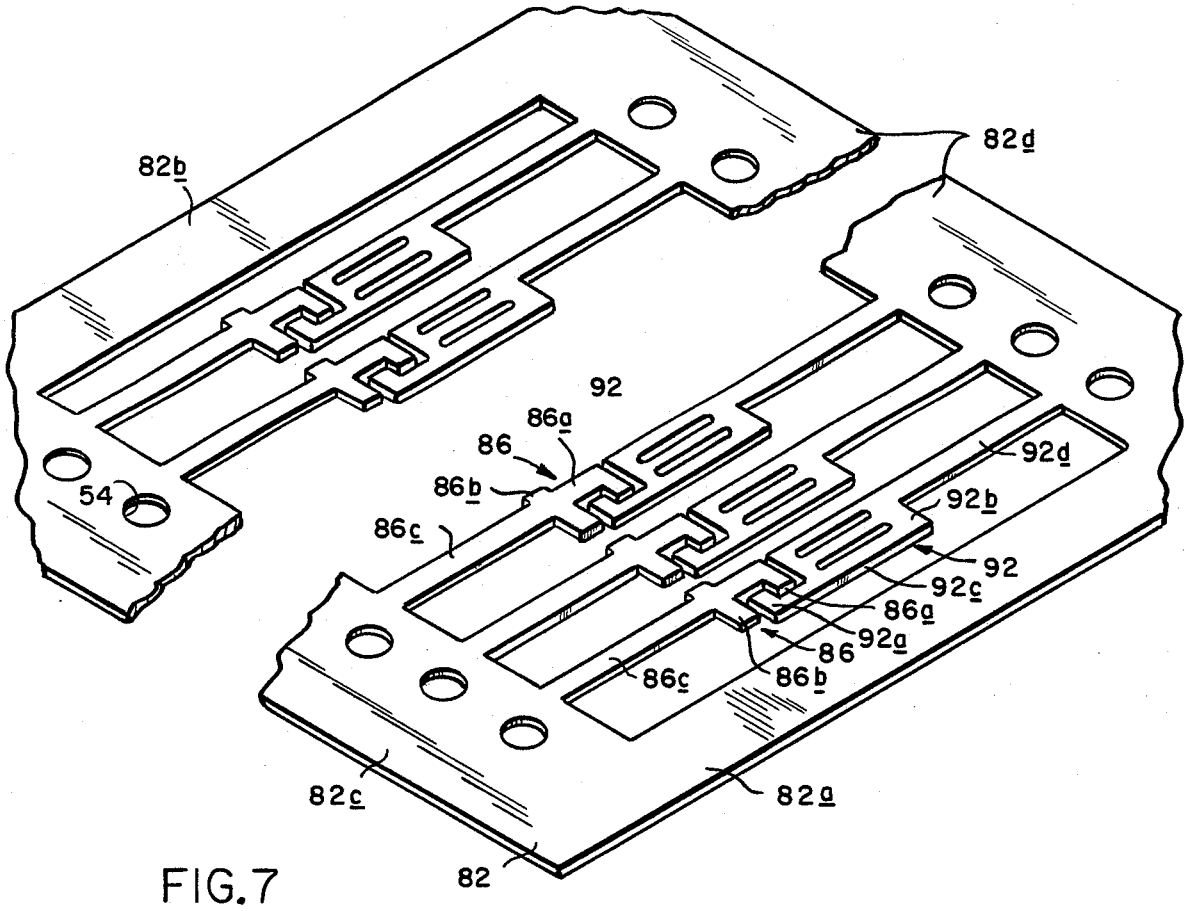
FIG.7
FIG.9
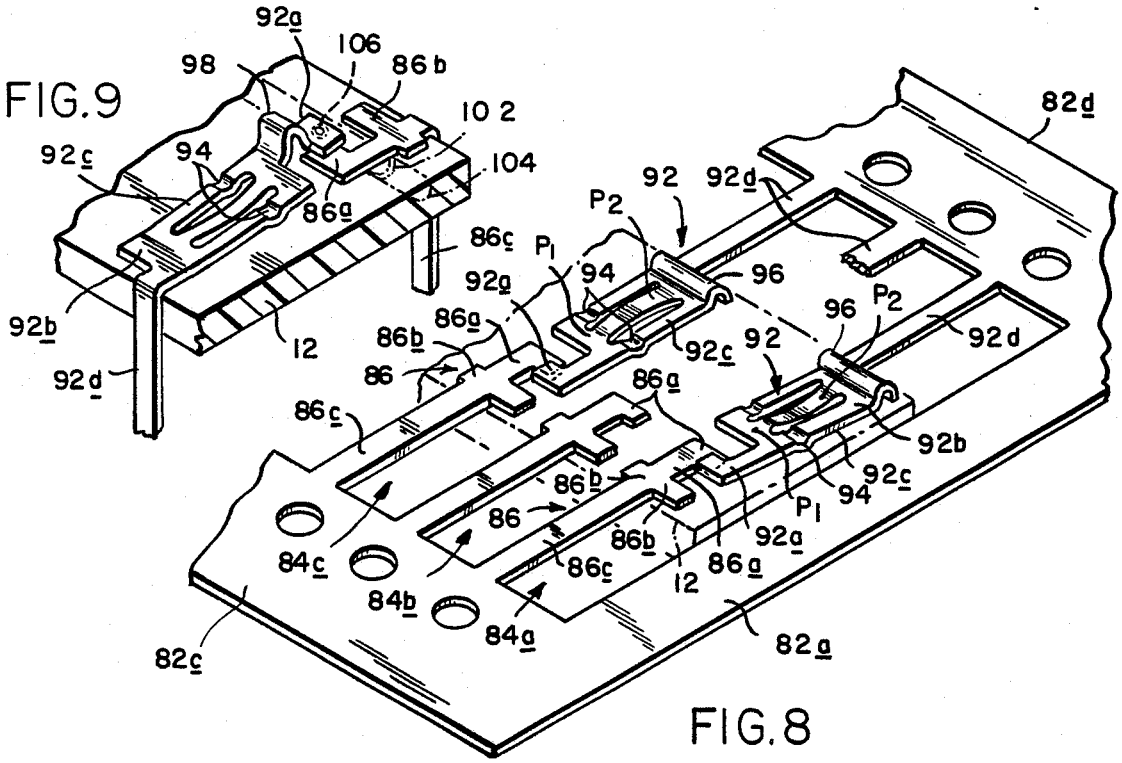
FIG.8

METHOD OF MAKING SNAP ACTION SWITCHES

This is a continuation of application Ser. No. 563,220 filed Dec. 19, 1983, now abandoned.

This invention relates to electrical switches. It relates more particularly to snap action switches and switch arrays and a method of making them economically and in very small sizes.

BACKGROUND OF THE INVENTION

Electrical snap action switches of the general type with which we are concerned here are already known in the art, examples being described in U.S. Pat. Nos. 2,700,079; 2,854,540 and 4,283,609, as well as in German patent Nos. DE 23 56 024; DE 24 11 426 and DE 27 40 902 and others.

A typical switch of this type includes a longitudinal spring-like moving contact arm having a shorter part in tension longitudinally of the arm opposed by a longer part in compression longitudinally of the arm so that the longer arm part will be bowed or arched out of the plane of the shorter arm part. One end of the arm is mounted to a base. The opposite free end of the arm carries a moving contact. Mounted to the base is a fixed contact which extends opposite the moving contact at the free end of the arm. The switch also includes an actuator which presses against the contact arm so as to move the longer arm part transversely through the plane of the shorter arm part in opposite directions so that the free end of the arm snaps or flips between a closed position wherein the moving contact on the arm resiliently engages the fixed contact and an open position wherein the moving contact is spaced from the fixed contact.

Invariably, the fixed and moving contacts of the prior snap action switches of this general type are made separately and require separate assembly to the switch base or other support, giving rise to alignment problems and increasing the overall cost of such switches. Also, as electrical circuits become smaller and smaller, it becomes more and more difficult to fabricate and fix the different switch parts with the accuracy and high tolerances required to produce such very small switches in quantity on a reliable basis. Moreover, in some applications, a number of such switches must be positioned in a very small space on a printed circuit board or the like, creating a problem of packing the switches together as closely as possible in an array, while still maintaining good electrical and mechanical isolation between adjacent switches in the array.

The snap action switches available heretofore as typified by the ones disclosed in the aforementioned patents do not lend themselves to such miniaturization as would make them suitable for use in such applications where small size, low cost and reliability are all required in a single switch or switch array.

SUMMARY OF THE INVENTION

Accordingly, the present invention aims to provide an electrical snap action switch or switch array all of whose conductive components derive from a single conductive sheet or blank.

Another object of the invention is to provide a snap action switch whose contacts, contact arms and terminals can be positioned precisely relative to one another to produce a reliable switching action.

A further object of the invention is to provide a snap action switch which can be made very small as an individual switch or as part of a multiple switch array.

Still another object of the invention is to provide a switch of this type which is relatively easy and inexpensive to make on a high volume production basis.

Another object of the invention is to provide a blank for forming one or more very small snap action switches.

Yet another object of the invention is to provide a method of making a snap action switch or switch array having one or more of the above characteristics.

Other objects will, in part, be obvious and will, in part, appear hereinafter.

The invention accordingly comprises the several steps and the relation of one or more of such steps with respect to each of the others, and the apparatus embodying the features of construction, combination of elements and arrangement of parts which are adapted to effect such steps, all as exemplified in the following detailed description, and the scope of the invention will be indicated in the claims.

Briefly, the present switches and switch arrays comprise stationary and moving switch contacts and terminals therefor all of which derive from a single planar blank of conductive material. In the case of relatively small switches and arrays, the blank is formed from a sheet of conductive material by an imaging and etching technique conventionally used in the manufacture of printed circuits; the blank for larger switches and arrays can simply be stamped from the conductive sheet.

In either event, each blank includes a pair of spaced-apart, generally parallel side margins and a pair of spaced-apart, generally parallel end margins which together form a generally rectangular frame. The blank further includes first and second sets of longitudinal panels which extend toward one another from opposite side margins of the blank, corresponding panels of the two sets being more or less collinear. The free ends of the panels of each pair are spaced close to one another and adjacent pairs of panels are spaced next to one another between the end mmargins of the blank.

One set of panels is used to form all of the stationary contacts in the switch array. Each such panel includes a first portion at the free end of the panel defining the contact itself, a second contiguous portion defining a mounting pad for that contact and a third panel portion extending from the pad to the blank side margin which defines a terminal for the stationary contact.

The other set of panels projecting from the opposite blank side margin are arranged to form all of the remaining conductive components of the switch array. Each panel in this set includes a first portion which defines a moving contact at the free end of the panel, a mounting pad therefor and a contact arm extending between those contact and pad-defining portions. Another panel portion exending from the pad end of the first portion to the blank side margin defines the terminal for the moving contact.

After shaping the planar blank as aforesaid, the blank is deformed at first selected locations on the portions thereof defining the contact arms so that different lengthwise parts of each arm assume different lengths making each arm portion a bistable member which can move the contact portion at the free end of that arm portion between two stable positions relative to the general plane of the arm poriton. The blank is also deformed at second selected locations so as to shift the free ends of the corresponding panels of the two sets of panels lengthwise relative to one another so that the contact-defining portions thereof oppose one another.

After deforming the blank thusly, all of the panel portions thereof defining mounting pads are affixed to a base or substrate. Then, the terminal defining panel portions are separated from the side margins of the blank to electrically isolate the adjacent panels of each set of panels and the terminal-defining panel portions are bent to the desired shapes. There is thus formed an array of snap action switches each of which is opened and closed by applying pressure to determined pressure points or sites on the contact arm of that switch.

A cover is positioned on the substrate to protectively enclose the array of switches, access to the switching pressure points on the various contact arms being had through small holes in the cover. If desired, small pin actuators can be slidably positioned in these holes to facilitate applying the switching pressure to the contact arms.

Following the above method, an array of switches having a variety of different configurations can be formed from a single blank. Furthermore, using conventional printed circuit techniques, these switches can be made quite small and be packed densely on the substrate so that a maximum number of such switches can be located in a given space, while still avoiding electrical and mechanical interferences between adjacent switches. Yet, because the critical conductive components of the switch array are formed from, and mounted to the substrate as, a single blank, despite their small size, the switches and switch arrays can be made in quantity to very tight tolerances so that they can operate reliably during a relatively long useful life. For the same reasons, the subject switches and switch arrays are relatively economical to make in quantity. Therefore, they should find wide use, particularly in connection with printed circuit applications.

BRIEF DESCRIPTION OF THE DRAWINGS

For a fuller understanding of the nature and objects of the invention, reference should be had to the following detailed description, taken in connection with the accompanying drawings, in which:

FIG. 7 is a view similar to FIG. 3 on a larger scale of the blank used to make the conductive components of still another switch array;

FIG. 8 is a view similar to FIG. 4 illustrating the formation of the switch array from the FIG. 8 blank; and FIG. 9 is a fragmentary perspective view of still another snap action switch array embodying the principles of this invention.

DETAILED DESCRIPTION OF THE PREFERRED EMBODIMENTS

Figure 1:
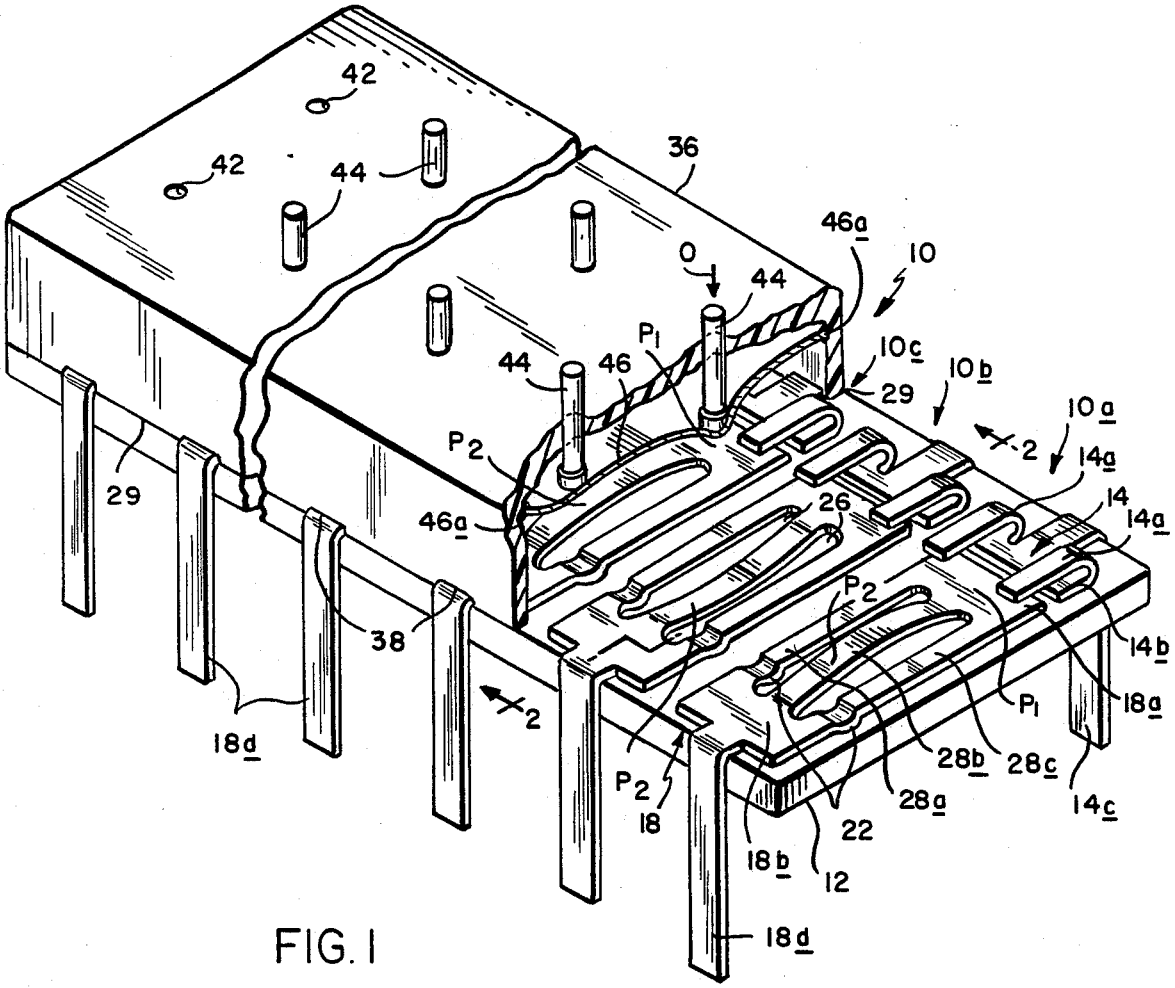
FIG. 1 is a perspective view with parts broken away illustrating an array of snap action switches made in accordance with this invention.
Figure 2:
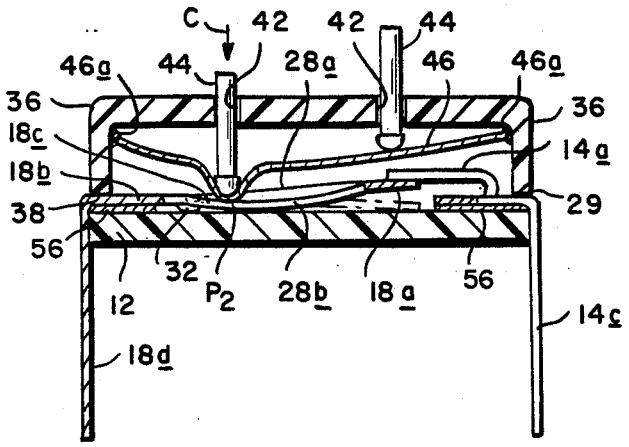
FIG. 2 is a sectional view along line 2—2 of FIG. 1.

Referring to FIGS. 1 and 2, a switch module made in accordance with this invention and indicated generally at 10 comprises a lengthwise array of identical, closely spaced switches 10*a*, 10*b*, 10*c*, etc. mounted to a rigid, rectangular electrically insulating base or substrate 12. It should be mentioned at the outset that the dimensions and spacing of the various switch parts have been exaggerated in the drawings for clarity.

Each switch comprises pairs of collinear elongated blades or panels 14 and 18 spaced side by side along the length of substrate 12. Each panel 14 includes one or more stationary conductive contacts 14*a* integral with a conductive mounting pad 14*b* which is affixed to substrate 12 by epoxy cement or other suitable means. A conductive strip 14*c* extends from pad 14*b* to the adjacent edge of substrate 12 and is bent downwardly to form a terminal for contact 14. Each contact 14*a* is formed or bent so that it is spaced above the substrate 12 and extends beyond pad 14*b* toward panel 18.

The panel 18 component of each switch 10*a*, 10*b*, 10*c*, etc. includes a conductive contact 18*a* at the end of the panel which is positioned under contacts 14*a*. That contact is connected to a conductive mounting pad 18*b* by an integral cantilevered conductive contact arm 18*c*, the pad being cemented to the substrate. An integral conductive strip 18*d* extends from pad 18*b* to the adjacent edge of substrate 12 and is bent downwardly to form the terminal for contact 18*a*.

A pair of spaced-apart parallel longitudinal slots 26 are present in arm 18*c* of each switch which divide that arm into three longitudinal strips 28*a*, 28*b* and 28*c*. Aligned crimps 32 are formed in the two outer strips 28*a* and 28*c* near the ends of the slots adjacent pad 18*b*. These crimps shorten the overall length of arm 18*c*, causing the middle arm strip 28*b* to bow or arch out of the plane of the two outer strips 28*a* and 28*c* so that the cantilevered arm constitutes a bistable member whose free end, including contact 18*a*, moves between two stable positions when pressure is applied to appropriate pressure points on the arm.

More particularly, when pressure is applied at the point $P_1$ of a contact arm as shown by the arrow 0 in FIG. 1, the free end of that arm snaps to a lower position against substrate 12 away from the stationary contact 14*a* thereby opening the switch. On the other hand, when pressure is applied to a contact arm at the pressure point $P_2$ as illustrated by the arrow C in FIG. 2, the free end of that arm flips to a stable upper position spaced from substrate 12. In this position, the contact 18*a* thereon resiliently engages contact 14*a* thereby to close the switch and establish an electrical connection between the switch terminals 14*c* and 18*d*. When the contact 18*a* engages against contacts 14*a*, the latter contacts flex to some extent giving rise to a wiping action which assures good electrical connections between those contacts.

The individual switches of module 10 are arranged so that the module forms a long thin package, with the switch terminals 14*c* and 18*d* extending down from the module in a so-called dual in-line parallel (DIP) array. That terminal configuration is used frequently for modules designed for mounting to printed circuit boards. That is, the various switch module terminals are positioned to project through registering holes in the associated printed circuit board. Conductive rings printed around those holes in the board constitute terminals for the circuitry on the board and, when the terminals are soldered to those rings, the module 10 is connected both mechanically and electrically to the circuit board.

Still referring to FIGS. 1 and 2, the switches 10*a*, 10*b*, 10*c*, etc. are protectively enclosed by a cover 36 molded of a suitable impact resistant plastic. The edge of cover 36 rests on the edge margin of substrate 12, the side walls of the cover having notches 38 to provide tight clearances for the switch terminals 14*c* and 18*d*. The cover and substrate are usually bonded together at their boundary by suitable means such as epoxy cement 29. Small holes 42 are formed in the top wall of cover 36 directly above the two pressure points $P_1$ and $P_2$ of each switch. Pairs of small, pin-like, headed actuators 44 made of plastic or metal are slidably received in each pair of holes so that, by pushing down on these actuators, the associated switches can be opened or closed. In those cases where it is not desirable to have a particular switch in module 10 too accessible, the corresponding pair of actuators 44 can be omitted as shown at the left end of module 10 in FIG. 1. In order to actuate that left-hand switch, then, one must insert a small pin or stylus through a left-hand opening 42 and push it against the contact arm of that switch.

Preferably, means are provided for isolating the switches inside module 10 from dirt or moisture that might enter the module through the actuator openings 42. In the illustrated embodiment, such sealing is provided by a flexible elastic membrane 46 (e.g. 3 mil polyurethane film) whose edges 46*a* are cemented, heat-sealed or otherwise secured to the inside surface of cover 36 all around the array of cover openings 42. In addition to its sealing function, the membrane 46 also biases the undepressed actuators 44 up out of engagement with switches 10 as shown in FIGS. 1 and 2.

The module 10 specifically illustrated in FIG. 1 contains six switches. Obviously, the number of switches in a given module may vary from one to five, ten or even more switches depending upon the requirements of the circuit in connection with which the module is used and the space available for the module.

It is a feature of this invention that the individual switches 10*a*, 10*b*, 10*c*, etc. can be made very small, as can the overall module 10. Indeed, modules 10 have been made whose individual switches are spaced apart only 0.1 inch on center, making the overall module about 0.30 inch wide and about 0.16 inch high. The length of the module depends, of course, upon the number of individual switches in the module. For an eight-switch module, that length is about 0.90 inches.

It is important to note also that, except for the conductive switch array itself, all of the components of module 10 can be simple plastic parts that are fabricated easily and inexpensively in quantity. Furthermore, as we shall see presently, all of the switches 10*a*, 10*b*, 10*c*, etc. in a given module are formed at one and the same time from a single conductive sheet, which factor dramatically reduces the cost of manufacturing and assembling the module. That factor also materially tightens the tolerances to which the individual switches can be held, and thus the overall reliability of the switch module as a whole during its operating life.

Figure 3:
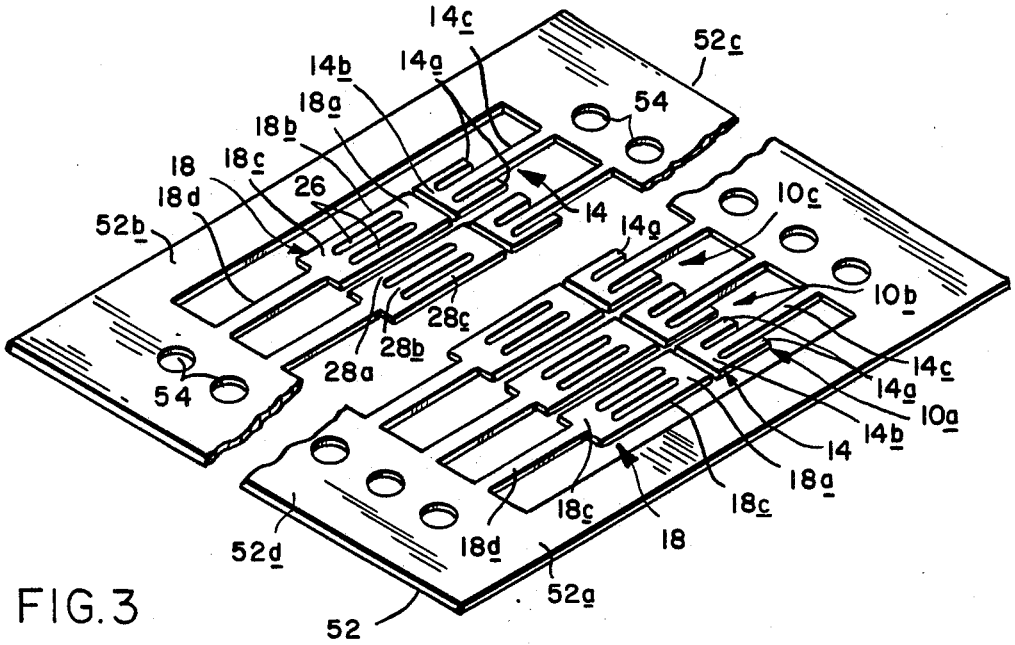
FIG. 3 is a fragmentary perspective view on a smaller scale of the blank from which all of the conductive components of the FIG. 1 switch array originate.

Referring now to FIG. 3 of the drawings, all of the switches 10*a*, 10*b*, 10*c*, etc. for a particular module 10, be it a one-switch module or a ten- or more-switch module derive from a single blank 52 formed from a sheet or ribbon of conductive material such as copper metal. If the switches are relatively large, the blank 52 may be formed by a stamping operation which stamps out the pattern or blank illustrated in FIG. 3.

More preferably, particularly for smaller size switches and arrays, blank 52 is formed from the conductive sheet by an imaging and etching process customarily used to make printed circuits. In other words, a photo-resist coating is applied to those areas of the sheet which are to remain to form the FIG. 3 blank. Then the sheet is subjected to an etching step which removes those areas of the sheet that do not bear the photo resist. This leaves the blank 52 which is then subjected to a cleaning step to remove the residual resist coating.

In either event, the blank is designed so that all of the conductive components of the switch array in module 10 are supported as panels within a closed frame formed by the blank. Since these panels define the various switch array parts, they are given the same identifying numerals as those parts. Thus, the illustrated frame 52 includes a front margin 52*a*, a rear margin 52*b* and a pair of spaced-apart, parallel side margins 52*c* and 52*d*. A first set of cantilevered, flexible resilient panels 14 that form all of the panels or blades 14 (including their portions 14*a* to 14*c*) of the switch array in module 10 are connected by the panel portions 14*c* to blank side margin 52*c*. A second set of cantilevered, flexible resilient panels 18 that form all of the panels or blades 18 (including their portions 18*a* to 18*d*) of that array are connected by the panel portions 18*d* to side margin 52*d*. The panels 14, 18 in each pair are more or less collinear, projecting toward one another from the opposite blank side margins to an extent that their free ends are closely spaced as shown. The term collinear as used here is not meant to mean that the longitudinal axes of the panels in each pair are geometrically the same, but rather that those panels extend or project generally toward one another from opposite sides of the frame.

Blank 52 is formed with pairs of longitudinal slits 26 in panel portions 18*c* dividing each such portion into strips 28*a* to 28*c*. Also, a series of small tooling holes 54 may be provided in the blank side margins 52*c* and 52*d* opposite the panel roots to help position blank 52 in the tools that operate on the blank to form the finished switch array in module 10.

Figure 4:
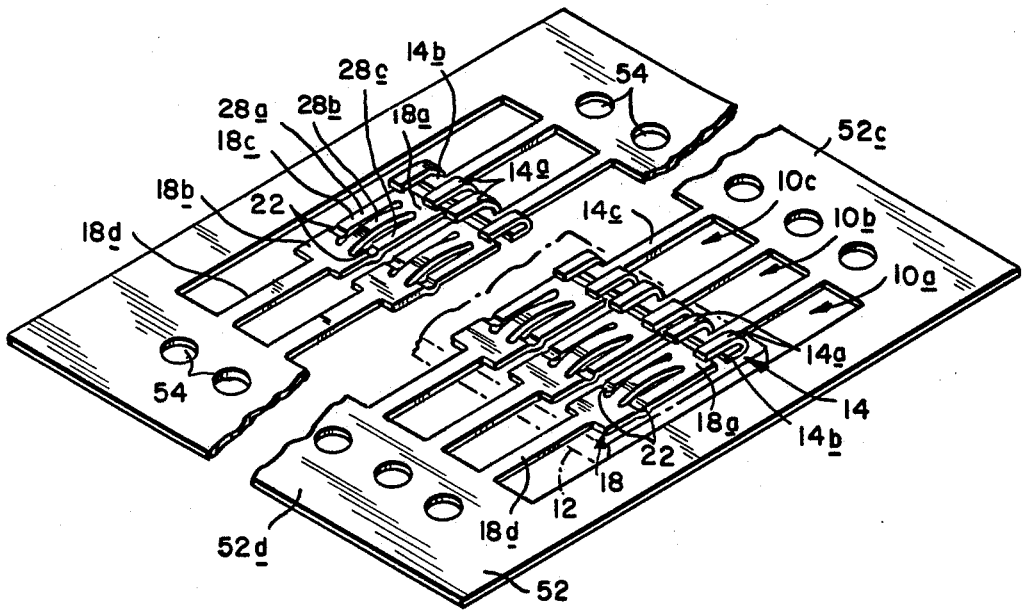
FIG. 4 is a similar view showing the formation of the FIG. 1 switch array from the FIG. 3 blank.

Turning now to FIG. 4, the blank 52, formed as aforesaid, is placed in a tool which deforms the blank so as to shorten the overall lengths of the arm-defining panel portions 18*c* so as to cause their middle strips 28*b* to assume a bowed shape, thereby making such portions 18*c* bistable. In the illustrated method, this is accomplished by providing a series of aligned lateral crimps 32 in the two outer panel portion strips 28*a* and 28*c* of all of the panels 18 in blank 52. In the illustrated blank, these crimps are located adjacent the mounting pad-defining portion 18*b* of the panels. Also, the contact-defining panel portions 14*a* of blank 52 are folded or bent back on themselves toward panels 18 so that they overlie the contact-defining panel portions 18*a* as shown in FIG. 4. At this point in the process, the portions of blank 52 that comprise all of the switches in module 10 already have the relative positions that they will have ultimately after being mounted to substrate 12.

Next, the formed blank is cleaned conventionally and may be spot plated in the contact areas, for example. Then, a coating of epoxy cement or other comparable adherent material is applied to the underside of the blank 52 over all of the pad-defining panel portions 14*a* and 18*b* and those portions are adhered to the upper surface of substrate 12 as indicated in FIG. 4. After the cement sets, all of the panels 14 and 18 are severed at their roots from the blank side margins 52*c* and 52*d* respectively, thereby electrically isolating the adjacent panels and thus forming the array of independent switches 10*a*, 10*b*, 10*c*, etc. The terminals 14*c* and 18*d* are then bent down perpendicular to the substrate into the DIP alignment illustrated in FIGS. 1 and 2.

Finally, the cover 36, with the headed actuators 44 held in place in their holes 42 by the elastic membrane 46 is positioned on and bonded to the substrate 12 to form the finished hermetically sealed module 10 as described above.

We have specifically described the formation of the bistable contact arms 18*c* from blank 52 by crimping the outside arm strips 28*a* and 28*c* to make those strips shorter than the middle strips 28*b*. Obviously, the same effect can be achieved by elongating the central strips 28*b* relative to the outer strips. This can be done by longitudinally coining or forging the blank in a series of aligned locations extending across the middle strips 28*b*, i.e., between the locations of crimps 22. This reduces the thickness of the metal in the forged areas forcing the metal to flow in the longitudinal direction along strips 28*b*, making those strips slightly longer than the corresponding outer strips 28*a* and 28*c*. The providing of arm bistability by coining or forging rather than by crimping is desirable in that the forged areas of the arms are very resistant to unwanted deformation. That is, it is practically impossible to deforge the metal, whereas the crimps 22 could be reextended either by tension on the switch arms 18*c* or by flattening those arms which extension could degrade the performance of the bistable switches.

It is important to note that when the switch array is mounted to substrate 12, the relative positions of all of the components of the array are already established by the frame margins 52*a* to 52*d*. Since the positions of adjacent switches 10*a*, 10*b*, 10*c*, as well as the positions of the two contacts comprising each switch are fixed, there is little likelihood of there being a misalignment of switch components on the substrate that would impair the performance of a switch or cause some electrical or mechanical interaction between adjacent switches.

Figure 5:
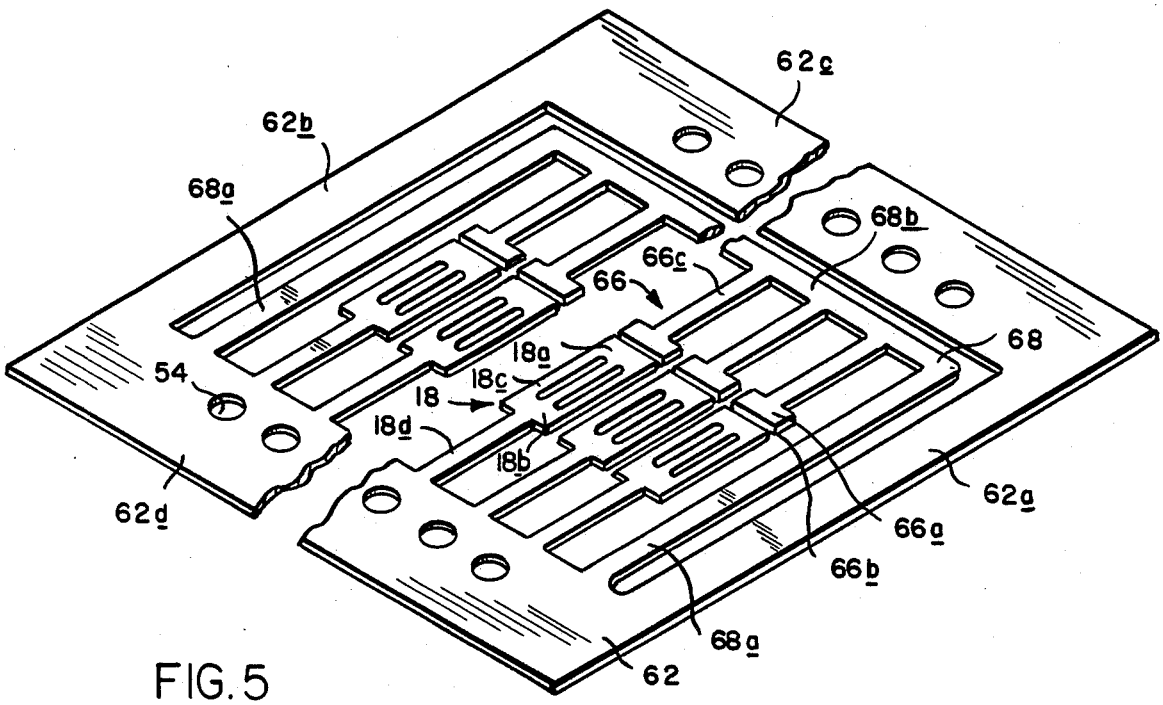
FIG. 5 is a view similar to FIG. 3 of another blank embodiment used to make the conductive components of a switch array similar to the FIG. 1 array.

The individual switches for a particular module 10 can be designed with a variety of different contact configurations depending upon the particular application and the required specifications for the switches. FIG. 5 illustrates a blank 62 whose panels form the array of switches 64*a*, 64*b*, 64*c* illustrated in FIG. 6. As before, the switch array is formed in the blank between the blank front, rear and opposite side margins 62*a* to 62*d* respectively. The moving contact-defining panels of blank 62 are supported by the side margin 62*d* and they are substantially identical to panels 18 of the FIG. 3 blank. Therefore, they carry the same identifying numerals.

Blank 62 has stationary contact-defining panels 66 which are somewhat different from their FIG. 3 counterparts. More particularly, each panel 66 has the general shape of the letter T whose cross portion constitutes both the stationery switch contact 66*a* and the mounting pad 66*b* for that contact. The leg portion 66*c* of each panel 66 constitutes the terminal for that contact. The series of panels 66 are, however, not supported by the blank side margin 62*c*. Rather, they extend from a generally rectangular inner frame 68 cantilevered from the blank side margin 62*d* outboard of panels 18 and 66. In other words, frame 68 has a pair of parallel legs 68*a* which originate from side margin 62*d* just inboard of the blank front and rear margins 62*a* and 62*b*. Those legs extend parallel to those margins almost to the opposite side margin 62*c* of the blank where they are connected together by a bridging portion 68*b*. That bridging portion supports the series of panels 66 by way of their terminal-defining portions 66*c*.

Figure 6:
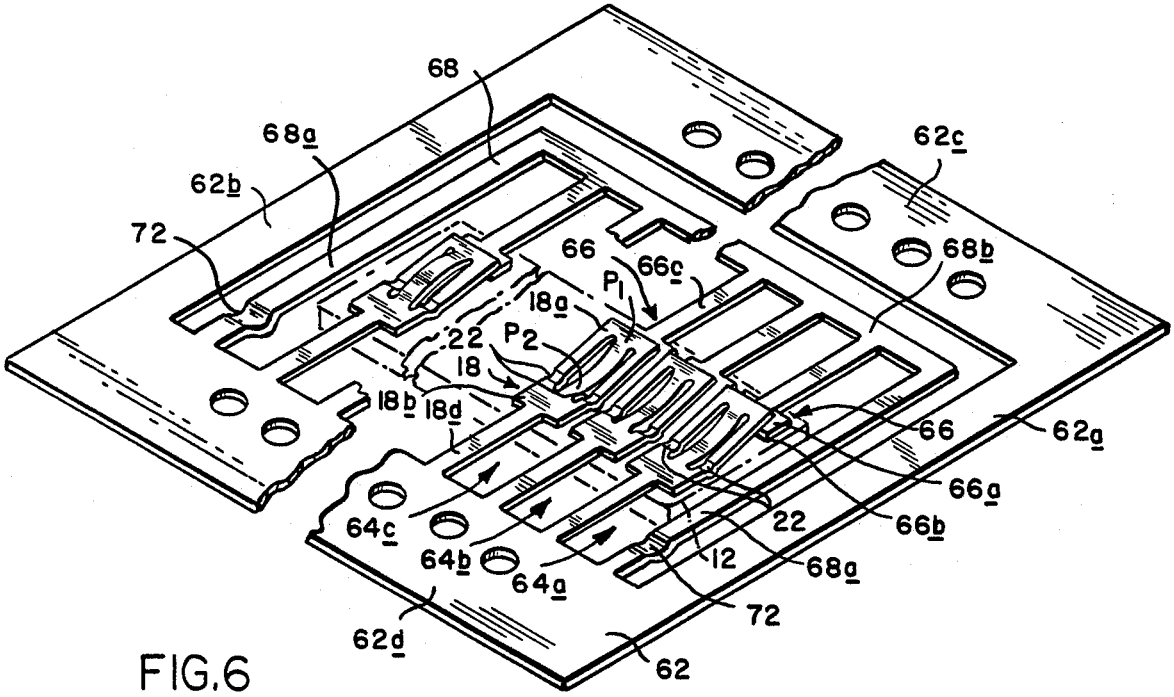
FIG. 6 is a view similar to FIG. 4 illustrating the formation of the switch array from the FIG. 5 blank.

Referring now to FIG. 6, blank 62 is deformed as by crimping at 22 to form the bistable contact arms 18*c* as described above. Then, the blank is deformed at second locations to move the panels 18 and 66 longitudinally relative to one another so that their contact-defining portions 18*a* and 66*a* at the free ends of those panels are disposed opposite one another. More particularly, aligned crimps 72 are formed in the frame legs 68*a* adjacent their roots. These crimps shorten those legs as shown in FIG. 6, thereby shifting the frame bridging portion 68*b* and the panels 66 supported thereby toward the blank side margin 62*d*. The amount by which the legs 68*a* are shortened is sufficient to move the panel portions 66*b* under the free ends of panels 18 so that their corresponding contact-defining portions 18*a* and 66*a* lie opposite one another as shown.

After the two sets of crimps 22 and 72 are formed in the blank 62 as illustrated in FIG. 6, the formed blank is cleaned and plated if necessary. Then all of the panels 18 and 66 are affixed by their pad-defining portions 18*b* and 66*b* to substrate 12. This is done while the frame 68 is still intact so that the relative positions of all of the components of switches 64*a*, 64*b*, etc. on substrate 12 are predetermined by the positions of those components in the crimped blank 62. Only after mounting the blank to the substrate are the panels 18 and 66 separated from the blank side margin 62*d* and the interior frame portion 68*b* respectively at the roots of panel portions 18*d* and 66*c*. Then those portions are bent down vertically in a DIP array and a cover 36 is engaged to the substrate as described above to form the finished switch module.

It should be noted that, unlike the switches depicted in FIG. 1, the switches 64*a*, 64*b*, 64*c*, etc. are closed by pressing down on the pressure points $P_1$ at the free ends of the contact arms 18*c* and they are opened by applying pressure at pressure points $P_2$ at the fixed ends of those arms. In other words, the switching action of each switch 64*a*, 64*b*, etc. is opposite that of each switch 10*a*, 10*b*, etc. shown in FIG. 1. This switching action is advantageous in some applications because the breaking of the switch contact occurs quite suddenly due solely to the snap action of the switch when pressure is applied at point $P_2$. Therefore, arcing is kept to a minimum. In the FIG. 1 switch, on the other hand, the downward force applied to the switch pressure point $P_1$ required to activate the switch may separate the contacts 14*a* and 18*a* sufficiently to cause arcing before the contact arm 18*c* snaps to its open position due to the over-center movement of its center strip 28*b*.

FIG. 7 illustrates a blank 82 for making the array of switches 84*a*, 84*b*, 84*c* depicted in FIG. 8 whose contacts have still another configuration. As before, the blank 82 has front, rear and spaced-apart side margins 82*a* to 82*d* which define a generally rectangular frame for supporting sets of collinear panels 86 and 92 which project toward one another from the blank side margins 82*c* and 82*d* respectively.

Each panel 86 is composed of contiguous portions or sections defining an L-shaped stationary contact 86*a*, a flat mounting pad 86*b* for that contact and a relatively long thin terminal 86*c* leading from pad 86*b* to the blank side margin 82*c*. Each panel 92 has a portion or section defining a generally L-shaped contact 92*a* connected to a pad-defining portion 92*b* by way of a longitudinal portion defining a contact arm 92*c*. The panel portion 92*b* is connected, in turn, by way of a terminal-defining panel portion 92*d* to the blank side margin 82*d*. As shown in FIG. 7, the two L-shaped contact-defining panel portions 86*a* and 92*a* of each panel pair interlock so that the short arms of those panels are offset longitudinally of the panels.

The blank 82 is then subjected to a first deformation shown in FIG. 8 to form a series of aligned crimps 94 in the contact arms 92*c*, similar to crimps 22 in FIG. 4, to make those arms bistable members as described above. The blank 82 then undergoes a second deformation to shift the panel portions 86*a* and 92*a* defining the sets of stationary and moving switch contacts longitudinally so that they repose opposite one another. More particularly, a series of aligned crimps 96 are impressed across the panels 92 at the junctions of their pad- and terminal-defining portions 92*c* and 92*d*. After such crimping, the short legs of the panel portions 86*a* and 92*a* lie directly opposite one another as shown in FIG. 8. If a switch is in its open position as is switch 84*a* in FIG. 8, and a force is applied at pressure point $P_1$ of that switch, the contact arm 92*c* snaps to its other stable position (see switch 84*c*) so that contact 92*a* is urged into resilient engagement with the stationery contact 86*a* thereby closing the switch. On the other hand, a force applied at pressure point $P_2$ of the closed switch suffices to snap the contact arm 92*c* to its other stable position which positions the moving contact 92*a* away from the stationary contact 86*a* thereby opening the switch (see switch 84*a*).

After cleaning and plating, the formed blank 82, while still intact, is mounted by way of its pad-defining panel portions 86*b* and 92*b* to substrate 12. Only then are the panels separated from the frame side margins 82*c* and 82*d*. As before, the terminal-defining panel portions 86*c* and 92*d* are then bent down and the switches 84*a*, 84*b*, etc. protectively enclosed by cover 36 as described above in connection with FIG. 1.

Instead of bringing the contact-defining panel portions 86*a* and 92*a* into opposition by crimps 96 adjacent pad portions 92*c*, the same result is achieved by crimping the long legs of the L-shaped panel portions 92*a* as shown at 98 in FIG. 9. Another way of achieving this same objective is by shortening the long leg of the stationary contact-defining panel portion 86*a* by crimping it as shown in dotted lines at 102 in FIG. 9. Preferably, that crimp should extend downward away from the moving contact 92*a* so that the crimp does not interact electrically with that moving contact. To ensure that the stationary contact 86*a*, after being crimped at 92, lies flat against substrate 12, a longitudinal groove may be formed in the substrate to accommodate the crimps 102 in all of the switches in the array as indicated in dotted lines at 104 in FIG. 9.

A switch module made using the FIG. 7 blank is somewhat wider than the other embodiments illustrated herein due to the interlocking, L-shaped, contact-defining panel portions 86*a* and 92*a* of the blank. In other words, in that embodiment, those contact-defining panel portions of the blank that are shifted are moved toward the side margin of the blank to which they are attached whereas, in the other switch embodiments, the blanks are deformed so as to shift the contact-defining panel portions away from the blank side margin to which they are attached.

If desired, to assure good electrical engagement between the stationary and moving contacts of each switch illustrated in FIGS. 8 and 9, the panel portions 86*a* of blank 82 can be bent up slightly out of the plane of the blank along the line where those portions join pad-defining panel portions 86*b*. In this way, when the mounting pads 86*b* are adhered to substrate 12, the stationary contacts 86*a* will extend away from the substrate and be somewhat compliant. Resultantly, there will be a wiping action between the corresponding stationary and moving contacts when the switches are closed.

Also, in some cases, it may be desirable to obtain a point contact between the stationary and moving contacts of each switch when the switch closes. This may be accomplished by forming a bump in the underlying surface of the moving switch contact 92*a* as shown in dotted lines at 106 in FIG. 9. Such bumps may be created by dimpling or denting the blank 82 from above at locations along a line centered on the short legs of the blank panel portions 92*a*. Of course, this same procedure may be followed with the other switch embodiments described above.

All of the switches described thus far have been bistable switches whose contact arms can repose in either a switch-open position or a switch-closed position. It should be understood, however, that the same method can be used to make a switch that is monostable, i.e. one whose moving contact arm reposes in either a switch-open or a switch-closed position. For example, an electronic keyboard or touch pad may comprise normally open monostable switch arrays actuated by keys, with the spring action of the switches also giving the keys the desired "feel" or feedback to the operator.

Such monostable switching action is achieved by preventing the contact arm strip that is arched or under compression, e.g. strip 28*b* in FIG. 1, from passing through the plane of the remaining arm strips 28*a* and 28*c* and assuming an arched position on the opposite side of the arm. For example, a linear series of spaced-apart bosses or bumps may be provided on the upper surface of substrate 12 which lie under the arched arm strips 28*b* when the crimped blank is mounted to the substrate. If such bumps were provided on the substrate 12 of the switch module 10, for example, the switches therein would normally remain open and be closed only as long as a downward force is maintained at the pressure points $P_2$ of those switches. On the other hand, if such bumps were provided on the substrates supporting the FIGS. 6, 8 and 9 switch arrays, those switches would normally remain closed and be open only as long as downward forces are applied at their pressure points $P_2$. Such monostable switching action can also be obtained by bending the switch contact arms upward slightly right adjacent to the boundaries between those arms and their mounting pads.

It will be seen from the foregoing, then, that switches and switch arrays made from a single conductive blank or sheet in accordance with the foregoing method can be made very small, yet with a high degree of accuracy so that all of the switches in the array (assuming they are intended to be identical switches) can have essentially the same electrical characteristics and respond to substantially the same switching forces. Because of the high manufacturing tolerances that can be achieved, the adjacent switches in a particular switch array need be separated only by distances that will avoid unwanted electrical and mechanical interaction between the adjacent switches. Since all of the conductive components of a particular switch array are formed from a single blank and are mounted to a substrate or base while still in the form of a blank, their relative positions on the substrate are predetermined and remain fixed. Therefore, there is no need even to allow tolerances for assembly of those components to the substrate. These factors coupled with the fact that the remaining non-conductive components of the switch module are simple inexpensive molded plastic parts enable the switch modules to be manufactured in quantity at relatively low cost.

It will thus be seen that the objects set forth above, among those made apparent from the preceding description, are efficiently attained. Also, certain changes may be made in the above method and in the above constructions without departing from the scope of the invention. For example, the various switches in a given switch array need not be identical as shown; they may have different configurations to suit particular applications. AIso, selected switches within an array may be interconnected by including appropriate conductive paths between selected panels of the particular blank used to form the switch array. Therefore, it is intended that all matter contained in the above description or shown in the accompanying drawings be interpreted as illustrative and not in a limiting sense.

It is also to be understood that the following claims are intended to cover all of the generic and specific features of the invention herein described.

What is claimed as new and desired to be secured by Letters Patent of the United States is:

1. The method of making an electric switch module comprising the steps of

A. forming from a sheet of conductive material a planar blank having a frame and first and second sets of elongated cantilevered panels which extend from opposite sides of the frame toward one another with the free ends of corresponding panels of the two sets being in relatively close proximity;

B. deforming the blank at first selected locations on the panels of a panel set so that first portions of the corresponding panels in said panel sets overlap to form switch contacts;

C. deforming the blank at second selected locations on the panels of one panel set so as to give bias to lengthwise segments of those panels so that they urge said first portions of those panels into or out of engagement with said first portions of the corresponding panels in the other panel set, said deforming at said second selected locations, places a shorter part of said lengthwise segment of each panel of said one panel set in tension and a longer part of said lengthwise segment of each panel of said one panel set in compression, longitudinally of that panel so that each said lengthwise segment constitutes a bistable member which snaps between two stable positions when forces are applied against two different locations on that panel, in one of which positions said first portion of that panel engages said first portion of the corresponding panel in the other panel set, in the other of which positions said first portion of that panel is spaced from said first portion of the corresponding panel in the other panel set;

D. mounting the panels of the two panel sets while they are still integral parts of the deformed blank to a base so that the relative positions on the base of all of the panels in each set are predetermined by their positions in the deformed blank; and E. subsequently severing the deformed and mounted blank at selected locations to electrically isolate selected panels of each panel set.

2. The method defined in claim 1 including the additional steps of

A. dimensioning the base so that end segments of the panels of each set remote from said first portions thereof overhang opposite edges of the base; and B. bending said end segments generally perpendicular to said first portions so as to form a dual inline parallel terminal array.

3. The method defined in claim 2 and including the additional step of mounting a cover to the base to protectively enclose the said first contact-defining panel portions.

4. The method defined in claim 3 and including the additional step of forming one or more openings in the cover opposite said lengthwise segment of each panel in said one panel set.

5. The method defined in claim 1 wherein the forming step includes

A. applying a resist coating to areas of said conductive sheet that are to form said blank, and B. etching away those portions of said conductive sheet that do not carry said resist coating.

6. The method defined in claim 1 wherein the deforming of the blank at said first selected locations occurs adjacent to the free ends of the panels in said other of a panel set.

7. The method defined in claim 1 wherein the deforming of the blank at said first selected locations occurs adjacent to said lengthwise segments of said panels in said one panel set.

8. The method defined in claim 6 wherein

A. said first portions of the corresponding panels of said other panel set are each formed with a pair of parallel tabs which extend away from the free ends of those panels toward the frame side from which those panels extend; and B. wherein the deforming of the blank at said first selected locations bends said tabs back on themselves so that their free ends overlie or underlie said first portions of the panels of said one panel set.

* * * * *